United States Patent [19]

Ueda

[11] Patent Number: 4,831,239

[45] Date of Patent: May 16, 1989

[54] AUTOMATIC HEATING APPLIANCE WITH ULTRASONIC SENSOR

[75] Inventor: Shigeki Ueda, Yamatokoriyama, Japan

[73] Assignee: Matsushita Electric Industrial Co., Ltd., Japan

[21] Appl. No.: 111,434

[22] Filed: Oct. 21, 1987

[30] Foreign Application Priority Data

Oct. 22, 1986 [JP] Japan ..... 61-251111
Jan. 26, 1987 [JP] Japan ..... 62-15506

[51] Int. Cl.[4] ..... H05B 6/68

[52] U.S. Cl. ..... 219/518; 219/10.55 B; 219/10.55 F; 340/686; 99/325

[58] Field of Search ..... 219/10.55 B, 10.55 F, 219/10.55 R, 10.55 E, 518, 482, 490; 340/686; 99/325, DIG. 14, 451; 73/627

[56] References Cited

U.S. PATENT DOCUMENTS

| | | | |
|---|---|---|---|
| 4,157,464 | 6/1979 | Smith et al. | 219/10.55 R |
| 4,278,866 | 7/1981 | Nevins et al. | 73/627 X |
| 4,434,341 | 2/1984 | Busby | 219/10.55 F X |
| 4,456,806 | 6/1984 | Arimatsu | 219/10.55 F X |
| 4,591,684 | 5/1986 | Tanabe et al. | 219/10.55 B |
| 4,596,914 | 6/1986 | Morino | 219/10.55 B |

FOREIGN PATENT DOCUMENTS

| | | |
|---|---|---|
| 51-134951 | 1/1976 | Japan . |
| 58-43329 | 3/1983 | Japan . |

*Primary Examiner*—Philip H. Leung
*Attorney, Agent, or Firm*—Lowe, Price, LeBlanc, Becker & Shur

[57] ABSTRACT

A heating appliance comprising a heating chamber, a heating device for heating an object which is encased in the heating chamber and a turntable provided in the heating chamber and arranged to be rotatable about its own axis and to hold thereon the object. Included therein are an ultrasonic sensor for transmitting an ultrasonic wave toward the object and receiving an echo wave returning therefrom and a control unit for controlling the ultrasonic sensor. The control unit successively calculates the distances of the object from the ultrasonic sensor on the basis of the transmission and reception of the ultrasonic wave and determines the heating condition of the object on the basis of the successively calculated distances and controlling the heater in accordance with the determined distinctive feature. This does not require an input operation in terms of the class and category of the object to be heated, resulting in improving the automation of the heating appliance.

11 Claims, 9 Drawing Sheets

AUTOMATIC HEATING APPLIANCE WITH ULTRASONIC SENSOR

BACKGROUND OF THE INVENTION

The present invention relates generally to automatic heating appliances, and more particularly to an automatic heating appliance for controlling heating by recognizing, or discriminating, the distinctive feature of an object of be heated with an ultrasonic sensor.

Known as a heating appliance in which the heating time period is automatically controlled is a microwave oven in which the cooking time period is controlled using a humidity sensor or a gas sensor for detecting vaper or various gases generated from the heated food. Further realized are heating apparatus of the types in which the temperature of the surface of a food is detected by means of an infrared sensor, i which the weight of a food is detected by a weight sensor and in which the both of the surface temperature and food weight are detected thereby. An important problem in these prior heating appliances is that the heating control can be performed under the condition that the kind, or class, of an object and the category of cooking are inputted, for example, through keys on an operating panel. That is, the finishing temperature of the object is varied in accordance with the category of cooking. Generally, there is the difference in finishing temperature between the case of reheating the food and the case of thawing a frozen food, for example, the former being about 70° C. to 80° C. and the latter being about 0° C. to 10° C. Furthermore, the heating time period to be taken is also varied in accordance with the kind of material. Since the prior sensors cannot detect the category of cooking and the kind of material, the heating appliance requires instructions in terms of the cooking category and the kind of food material for automation of the cooking. The inputting thereof is troublesome and hence a further improvement would be required from the viewpoint of simplification of handling of the apparatus.

SUMMARY OF THE INVENTION

It is therefore an object of the present invention to provide a new and improved heating appliance which is capable of accurately controlling the heating time period without instructing the kind of food material and the category of cooking.

A feature of the present invention is that the heating condition of an object to be heated is determined on the basis of the data from an ultrasonic sensor which is arranged to measure the distance to the object and a heating time period is controlled in accordance with the heating condition.

In accordance with the present invention, there is provided a heating appliance with a heating chamber, comprising: heating means for heating an object which is encased in said heating chamber; turntable means provided in said heating chamber and arranged to be rotatable about its own axis, said object being placed on said turntable means and being rotated in accordance with rotation of said turntable means; ultrasonic sensor means for transmitting an ultrasonic wave toward said object and receiving an echo wave returning therefrom; and control means for controlling said ultrasonic sensor means so as to successively calculate the distances of said object from said ultrasonic sensor means on the basis of the transmission and reception of the ultrasonic wave, said control means determining the heating condition of said object on the basis of the successively calculated distances and controlling said heating means in accordance with the result of the determination.

In accordance with the present invention, there is further provided a heating appliance with a heating chamber, comprising: heating means for heating an object which is encased in said heating chamber; turntable means provided in said heating chamber and arranged to be rotatable about its own axis, said object being placed on said turntable means and being rotated in accordance with rotation of said turntable means; ultrasonic sensor means for transmitting an ultrasonic wave toward said object and receiving an echo wave returning therefrom; weight sensor means for sensing the weight of said object placed on said turntable means; and control means for controlling said ultrasonic sensor means so as to successively calculate the distances of said object from said ultrasonic sensor means on the basis of the transmission and reception of the ultrasonic wave, said control means determining the volume of said object on the basis of the successively calculated distances and calculating the density of said object on the basis of the determined volume and the weight sensed by said weight sensor, said control means controlling said heating means in accordance with the calculated density of said object.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
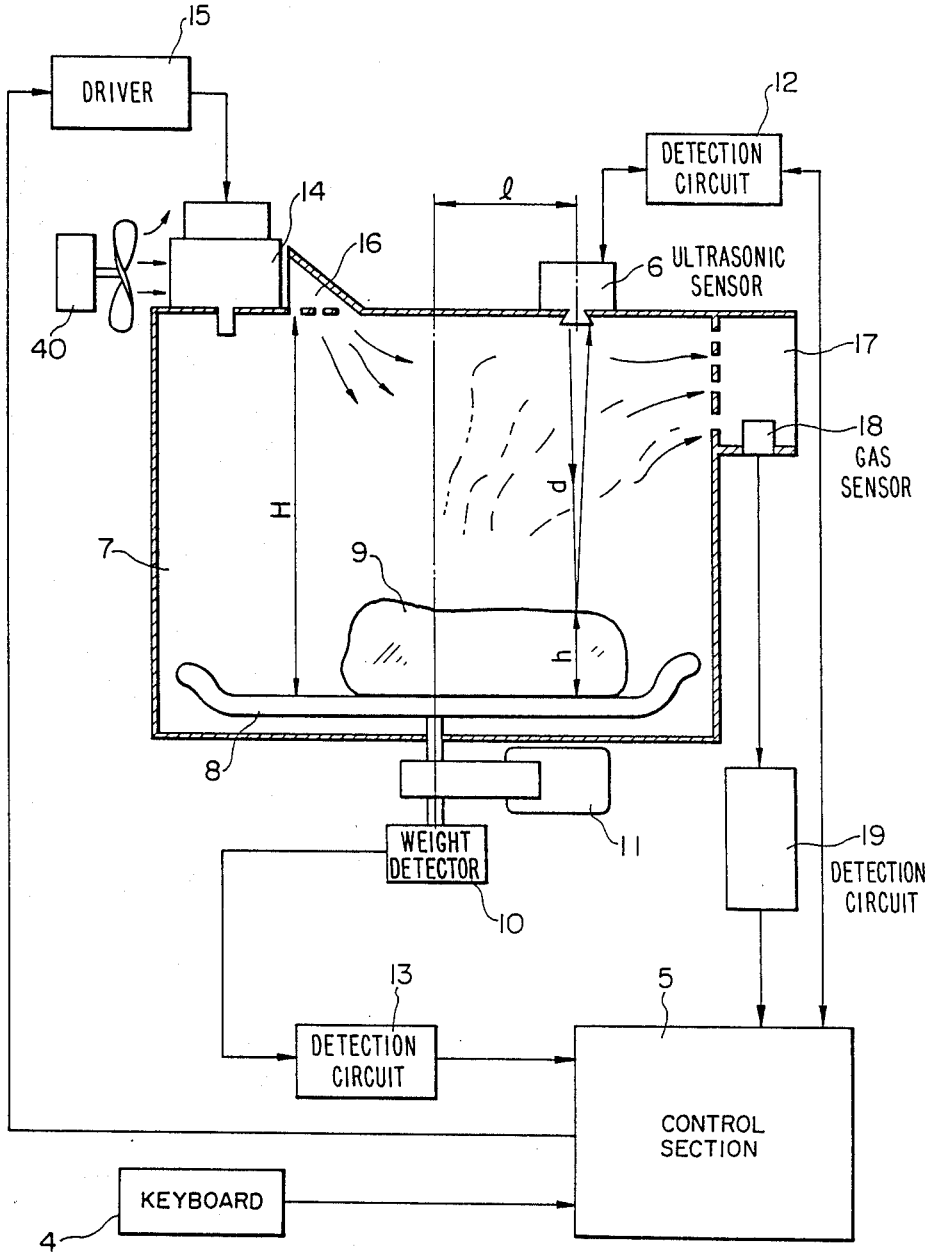
FIG. 1 is a block diagram showing the arrangement of an automatic heating appliance according to a first embodiment of the present invention.
Figure 2:
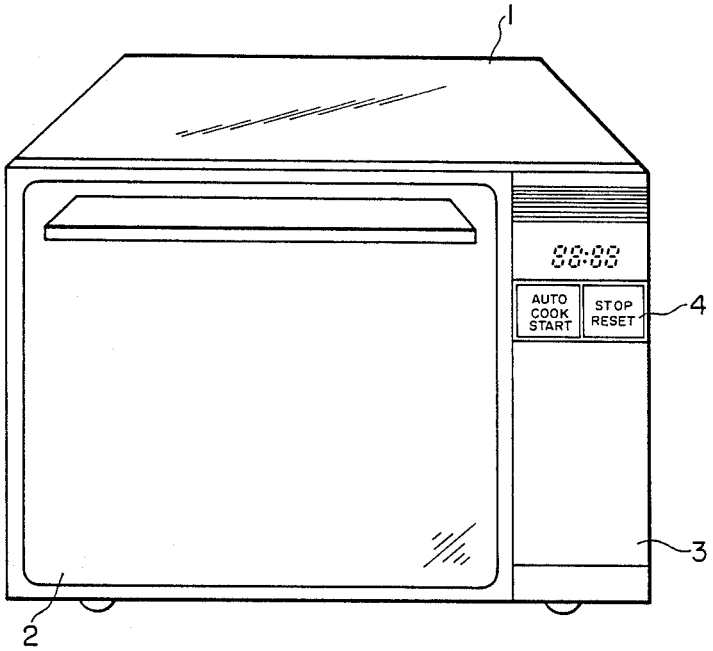
FIG. 2 is a perspective view showing the external form of the automatic heating appliance.

Referring now to FIG. 1, there is illustrated the arrangement of an automatic heating appliance according to an embodiment of the present invention. In FIG. 1, a heating instruction is transmitted to a control section 5 through a keyboard 4 on an operating panel 3 which are illustrated in FIG. 2 which is a perspective view showing the external appearance of the automatic heating appliance according to the embodiment of the invention and wherein numerals 1 and 2 represent a housing and a door, respectively. In response to the heating instruction, the control section 5, may comprising a known microcomputer with a central processing unit (CPU) and memories, energizes an ultrasonic sensor 6, provided on the ceiling of a heating chamber 7, so that the ultrasonic sensor 6 emits an ultrasonic wave downwardly to measure the distance d to an object 9, to be heated, placed on a turntable 8 by reception of an echo wave returning from the object 9, which is positioned below the ultrasonic sensor 6. The ultrasonic sensor 6 is driven through a drive and detection circuit 12 and the signal indicative of the distance data is supplied therethrough to the control section 5. The distance H between the ultrasonic sensor 6 and the turntable 8 is known in advance, and the height h of the object 9 is obtained as $h=H-d$, this calculation being made in the control section 5. Due to rotation of the turntable 8 made by means of an electric motor 11 under control of the control section 5, the position of the object 9 is varied with respect to the ultrasonic sensor 6 and the height h of the object 9 is measured successively in the control section 5 which in turn detects the revolved cross-section of the object 9, resulting in allowing recognition of shape thereof, which will hereinafter be described in detail.

Further provided in the automatic heating appliance is a weight sensor 10 for measuring tee weight of the object 9, which is coupled to the drive shaft of the turntable 8. The weight data is supplied through a detection circuit 13 to the control section 5. The weight sensor 10 may be of one of known various types, for example, in which the displacement of the turntable 8 is detected as the variation of electric capacity, the detection circuit 13 will be arranged in accordance with the type of the weight sensor so as to generate a signal corresponding to the detected weight. The weight sensor 10 is preferably used for the purposes of calculating the heating time period on thawing of a frozen food and so on and further, in this embodiment, of obtaining the density of the object 9 by working together with the ultrasonic sensor 6. That is, it is possible to derive the density of the object 9 from the weight data and the volume data estimated on the basis of the shape data obtained by the ultrasonic sensor 6. The shape and density are effectively used to accurately discriminate the kind of the object 9. This will be hereinafter described in detail.

In accordance with the discrimination of the nature of the object 9, the control section 5 starts to supply power through a driver 15 to a heater 14 with a magnetron which in turn generates a heat. In response to heating, a cooling fan 40 is driven to cool the magnetron of the heater 14 and the cooling air is introduced through an intake guide 16 into the heating chamber 7 which is in turn ventilated. After ventilated, the introduced air is exhausted through an exhaust guide 17 to the outside. Provided in the exhaust guide 17 is a gas sensor 18 for detecting the vaper and various gasses generated from the heated object 9. As the gas sensor 18 can be used the relative humidity sensor "HUMISERAM" or the absolute humidity sensor "NEO HUMISERAM" made by Matshshita Electric Industrial Co., Ltd, for example. The gas data of the gas sensor 18 is supplied through a detection circuit 19 to the control section 5.

Figure 3:
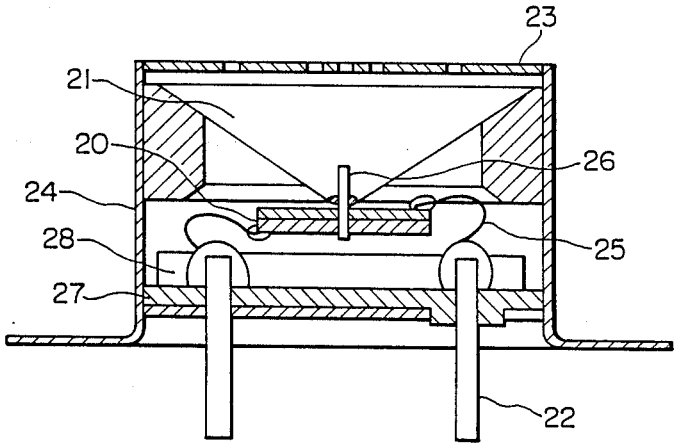
FIG. 3 is a cross-sectional view showing one example of narrow-superdirectional ultrasonic sensors employed in the automatic heating appliance.

FIG. 3 is a cross-sectional view showing one example of the ultrasonic sensor 6, i.e, a narrow super directional ultrasonic microphone. As shown In FIG. 3, the ultrasonic sensor 6 comprises a piezoelectric device 20, a conically shaped resonator 21, a terminal 22,, bean shaping plate 23, a case 24, lead lines 25, a coupling shaft 26, a terminal plate 27 and an acoiustic absorption sheet 28, the detailed arrangement thereof being disclosed in "National Technical Report" Vol. 29, pages 504 to 514, January 1983.

Figure 4:
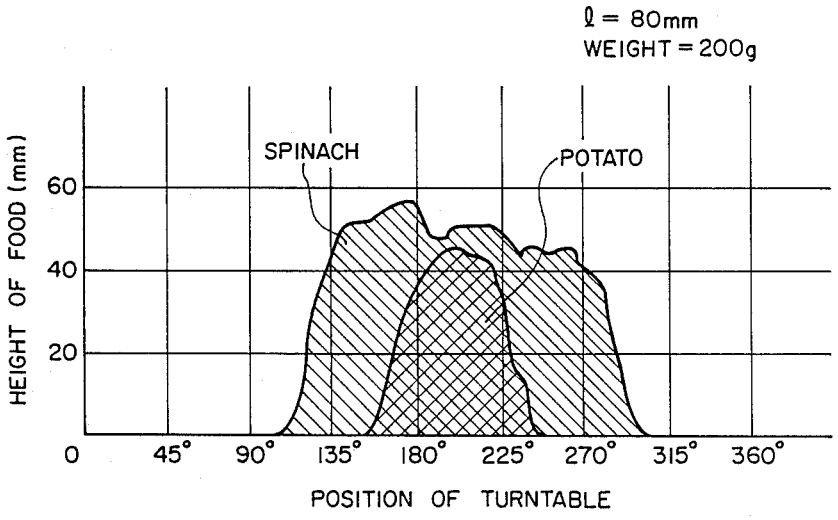
FIG. 4 is an illustration of revolved cross sections of objects to be heated, by measuring the heights thereof using the ultrasonic sensor.

FIG. 4 is an illustration of the shapes of heating objects detected using the ultrasonic sensor 6, wherein the horizontal axis represents the position (rotational angle) of the turntable 8 and the vertical axis represents the height of the heating objects. Shadowed portions represent the revolved cross sections of two objects, for example, spinach and potato,. with respect to the rotating center apart by l (FIG. 1) from the ultrasonic sensor 6. Thus, the entire shape of the object 9 can be estimated, under the condition that the ultrasonic sensor 6 is positioned appropriately. On the other hand, If the weight data of the object 9 is further obtained in addition to the entire shape, i.e., volume, the class of the object 9 can be estimated. That is, for example, in the case that the volumes of two heating objects are equal to each outer, the classes thereof can be estimated on the basis of the difference between weights thereof. In the acutal process, the control section 5 calculates the density of the object 9 by dividing the area, or volume, of the revolved cross-section thereof by the detected weight thereof and determines the class of the object 9 on the basis of the calculated density using a look-up table, or map, stored in a memory (ROM) of the control section 5.

Figure 5:
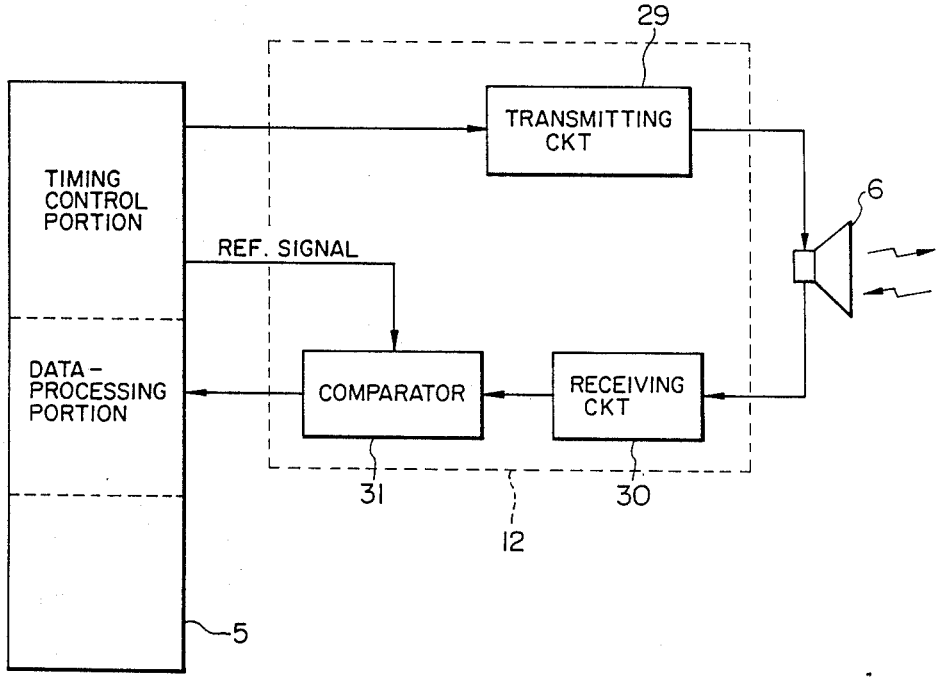
FIG. 5 is a block diagram showing an arrangement of a drive and detection circuit provided between the ultrasonic sensor and a control unit.

FIG. 5 is a block diagram showing the arrangement of the drive and detection circuit 12 coupled to the control section 5. The drive and detection circuit 12 comprises a transmitting circuit 29 and a receiving circuit 30. The transmitting circuit 29 drives the ultrasonic sensor 6 in response to a timing control signal from the control section 5 and the receiving circuit 30 receives an output signal of the ultrasonic sensor 6 corresponding to the echo wave returning from the object 9. The output signal of receiving circuit 30 is supplied to a comparator 31 where the output signal of the receiving circuit 30 is compared with a reference voltage. If the output signal exceeds the reference voltage, the output signal is latched and supplied to the control section 5. The control section 5 counts the time period from the transmission to the reception and calculates the distance to the object 9 on the basis of the propagating speed of ultrasonic wave and then calculates the height of the object 9 in accordance with the above-mentioned equation. The gas sensor 18 and the detection circuit 19 may be realized in accordance with Japanese Patent Provisional Publication No. 51-134951, for example. Therefore, the description of the arrangement and control method thereof will be omitted for brevity.

With above-mentioned arrangement, the class of the object 9 can be determined and the heating time can be desirably controlled on the basis of the determined class. Although in the above description the class of the object 9 is estimated on the basis of its weight and volume, it is possible to estimate the class thereof only on the basis of the data from the ultrasonic sensor 6. However, in order to more accurately discriminate the class of the object 9, the weight data may be additionally used for the discrimination.

Figure 6:
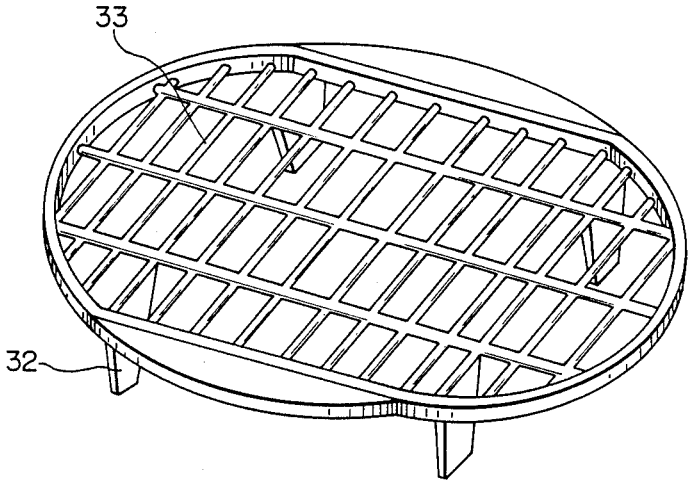
FIG. 6 is a perspective view showing an attachment used for thawing operation of a frozen food.
Figure 7:
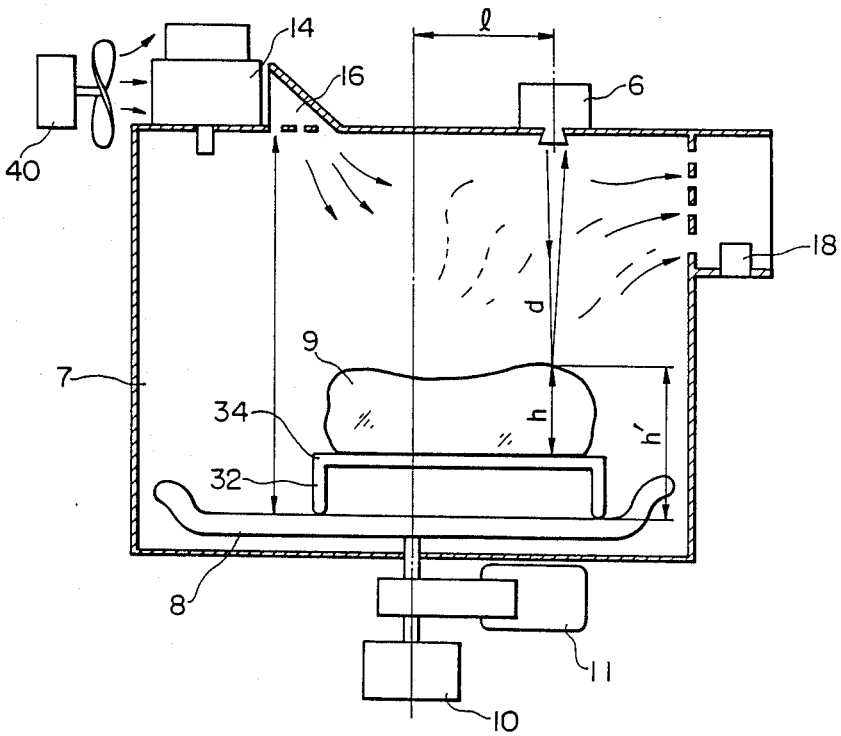
FIG. 7 is an illustration useful for describing the case of thawing a frozen food with the FIG. 6 attachment.
Figure 8:
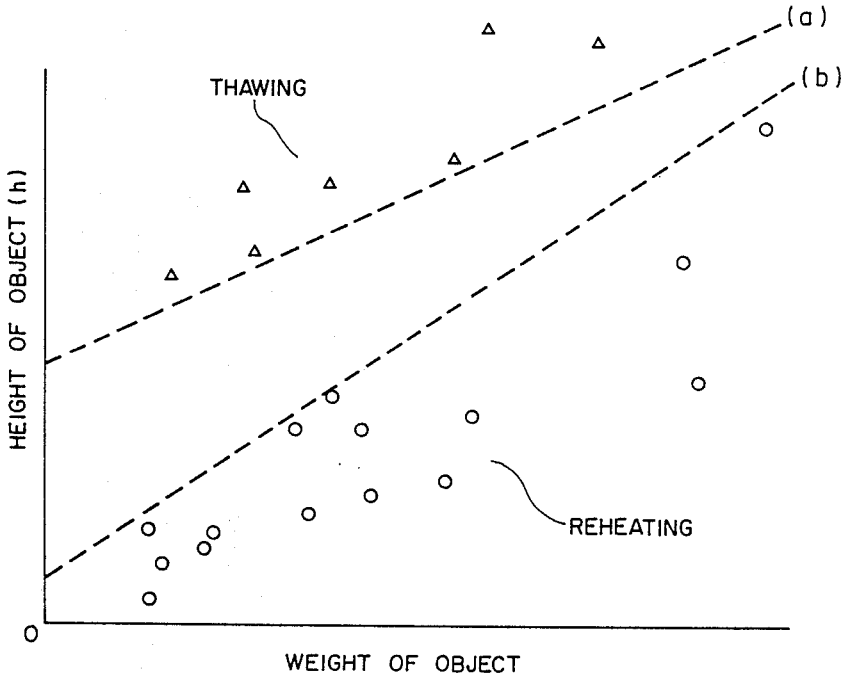
FIG. 8 is a graphic illustration for describing the relationship between the height and weight of an object to be heated in a heating chamber of the automatic heating appliance.
Figure 9A:
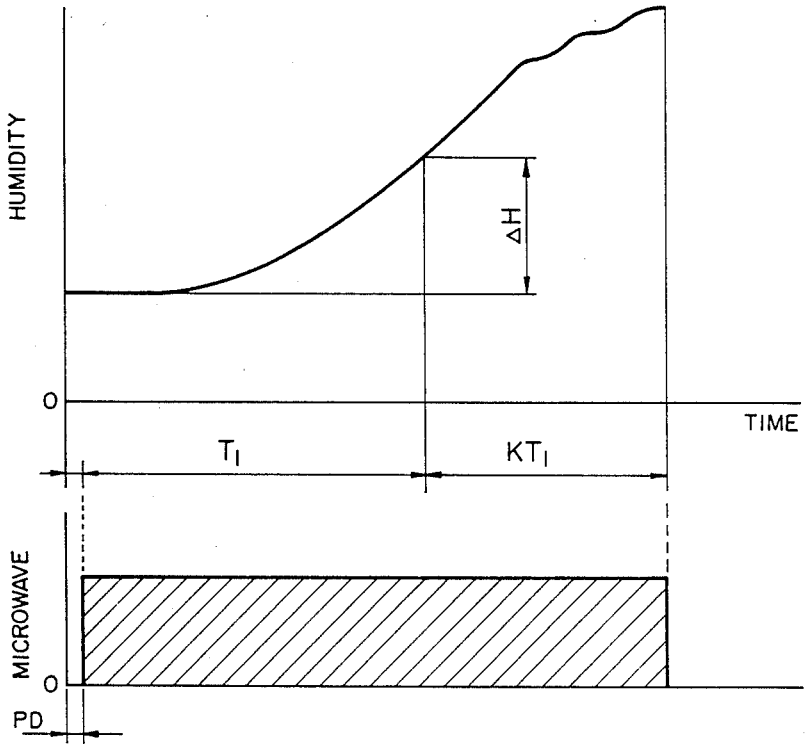
FIGS. 9(*a*) and 9(*b*) are timing charts showing heating processes performed by the control unit in accordance with category of cooking.
Figure 9B:
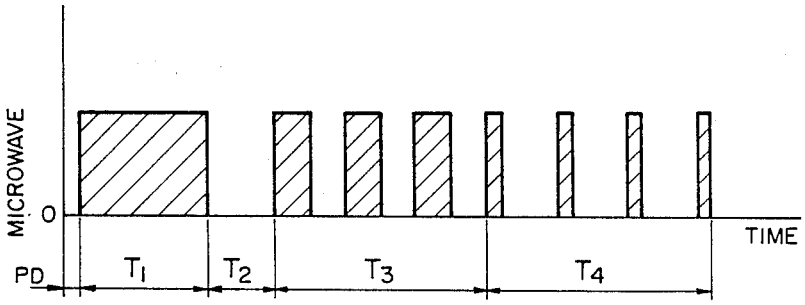

A description will be made hereinbelow in terms of discrimination of the category of cooking. The temperature in thawing of a frzzen food is lower (0° C. to 10° C.) as compared with other cases such as heating and reheating and hence a key instructing the thawing is generally required to be provided in the heating apparatus. However, in the embodiment of the present invention, since the thawing can be determined using the ultrasonic sensor 6, such a key is not required, resulting in a simple structure as shown in FIG. 2. FIG. 6 shows an attachment, disclosed in Japanese Patent Provisional Publication No. 58-43329, used on thawing cooking, which is made of a resin and which comprises leg portions 32 and a net portion 33. The attachment is generally used in thawing operation for the purposes of dropping down water droplets or gravy from a frozen food up to the turntable 8 to allow the food to be separated from the water or gravy. In the embodiment, the thawing is determined in accordance with the presence or absence of the attachment. The detection of the category of cooking will be described hereinbelow with reference to FIGS. 7 to 9. FIG. 7 shows the case that a frozen food placed on the FIG. 6 attachment 34 is thawed. As shown in FIG. 7, the detected height of the object 9 becomes higher by the height of the attachment as compared with the case of not employing the attachment 34. The attachment is light in weight because it is made in the leg structure and of a resin, and therefore it is possible to determine the presence or absence of the attachment 34 in accordance with the relationship between the weight detected by the weight sensor 10 and height h' detected by the ultrasonic sensor 6. FIG. 8 is a graphic illustration of the relationship therebetween. As understood from FIG. 8, in the case of using the attachment 34, i.e., thawing, the weight-height points are present above a dotted line (a), and on the other hand, in the case of not using the attachment 34, i.e, reheating, the weight-height points are present below a dotted line (b). Although a glass-made container with relatively high height is often used for reheating, the container is extremely heavier as compared with the attachment 34 made of a resin, and therefore the discrimination between thawing and reheating can be made on the basis of its weight and height. FIGS. 9(*a*) and 9(*b*) are illustrations for describing the automatic process performed in the embodiment wherein FIG. 9 (*a*) shows the case of reheating and so on and FIG. 9 (*b*) shows the case of thawing. Under the condition of not using the attachment 34, as shown in FIG. 9 (*a*), after elapse of a predetermined time period PD, a microwave is emitted continuously for heating of the object 9. The vapor or gas generated from the object 9 is detected by the humidity sensor 18. When the amount of the vaper exceeds a predetermined value ΔH, the control section 5 detects this fact and calculates the time period T1 taken for exceeding the predetermined value ΔH and calculates the additional heating time KT1 by multiplying T1 by K. K is a constant which is determined in accordance with the class of the object 9 so that the heating time is relatively extended, for example, when the density of the object 9 is relatively high. The heating of the object 9 is further performed for the additional heating time KT1. On the other hand, under the condition of employing the attachment 34, as shown in FIG. 9 (*b*), the microwave is intermittently emitted to reduce the average output so as to be suitable for thawing. The heating time periods T1 to T4 are determined as a function of the weight of the object 9. Although in the above description the heating is performed afterelapse of the predetermined timer period PD, this is for the purpose of preventing the microwave from providing bad influence to the ultrasonic sensor 6 and so on. With the above-mentioned arrangement, the automation of heating is further improved.

Figure 10:
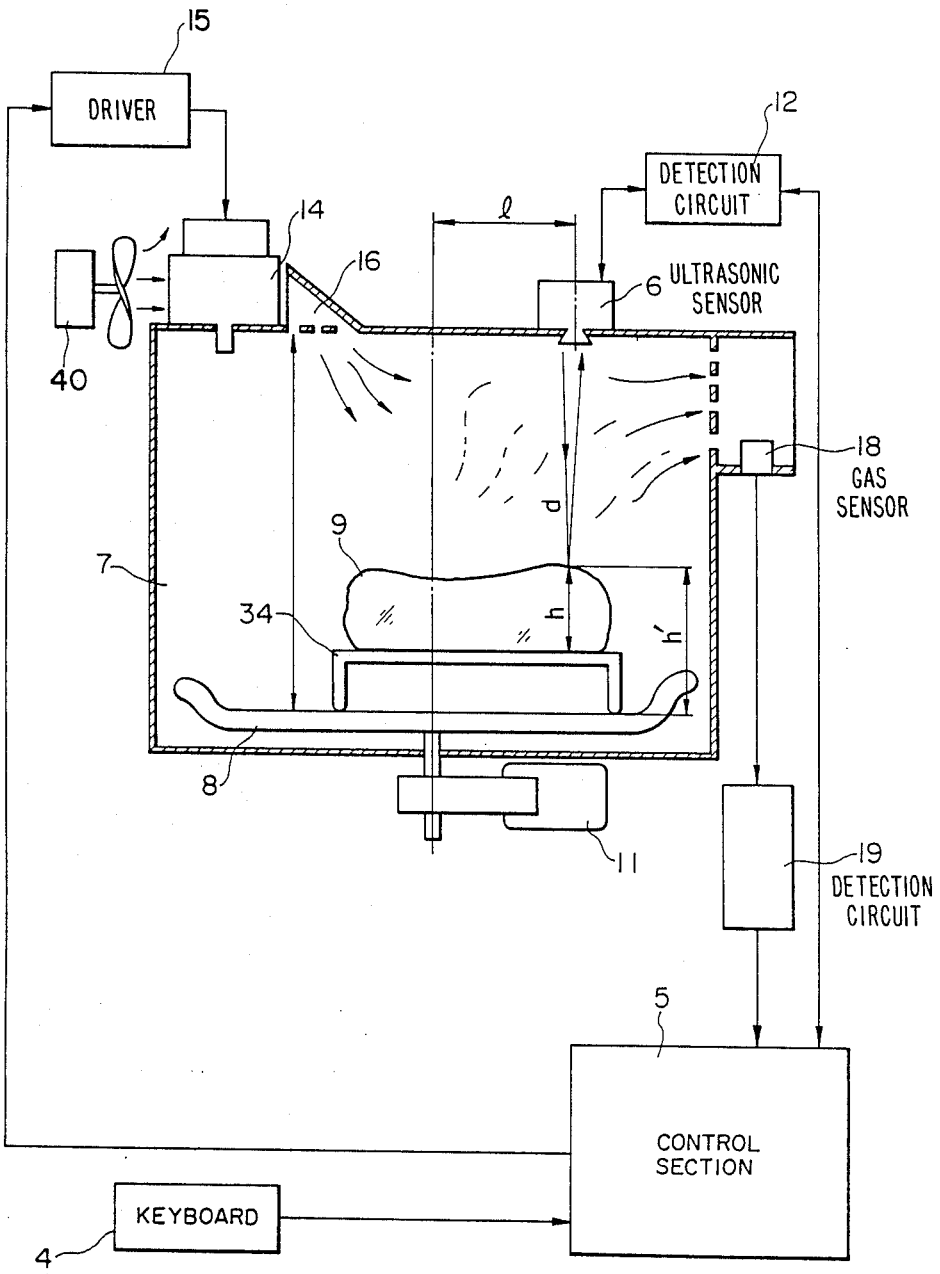
FIG. 10 is a block diagram showing an arrangement of an automatic heating appliance in which the category of cooking is detected only on the basis of the data from an ultrasonic sensor.
Figure 11:
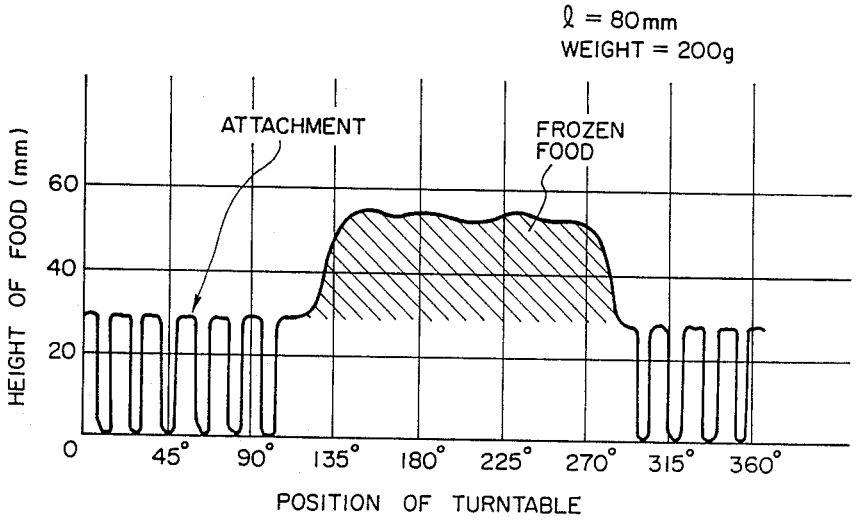
FIG. 11 is a graphic illustration for describing a way of detecting the category of cooking on the basis of the data from the ultrasonic sensor.

Here, description in terms of discriminating the class of the object 9 only on the basis of the data from the ultrasonic sensor 6 will be described hereinbelow. FIG. 10 shows an arrangement of an automatic heating appliance in which the class of the object 9 is recognized only on the basis of the data from the ultrasonic sensor 6. In FIG. 10, parts corresponding to FIGS. 1 and 7 are marked with the same numerals and, because the arrangement can be understood from the foregoing description of FIGS. 1 and 7, the description thereof will be omitted for brevity. FIG. 11 is a graphic diagram showing a revolved cross-section obtained by the ultrasonic sensor 6. As will be understood from FIG. 11, when the attachment 34 is used for thawing, the revolved cross-section includes a pulse-like varying portion which is caused by the leg portions 32 and net portions 33. Therefore, with the presence of the pulse-like varying portion being checked in the control section 5, it is possible to detect the category of cooking, i.e. thawing.

Figure 12:
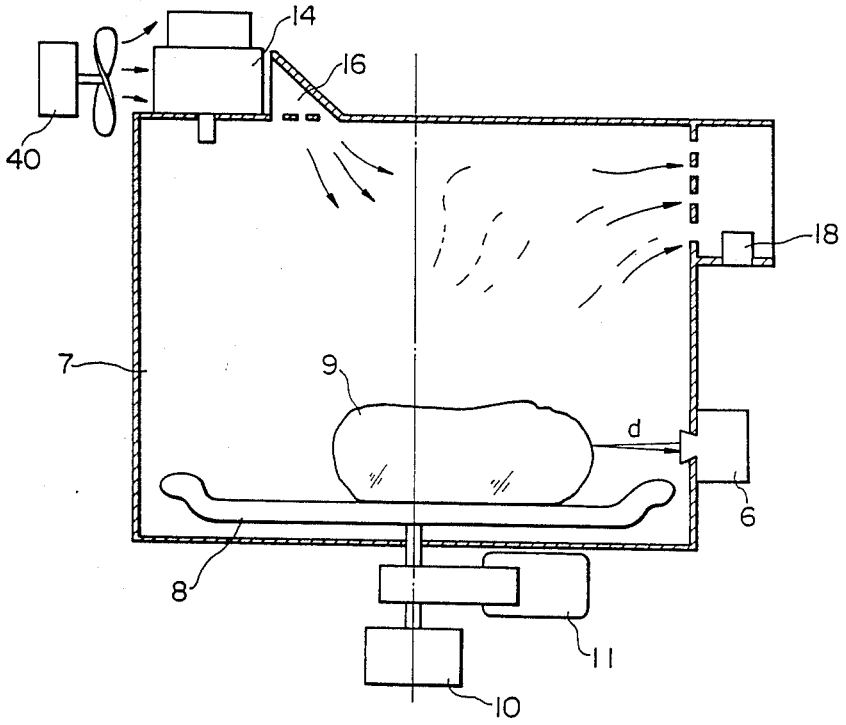
FIGS. 12 and 13 are cross-sectional views for describing an arrangement of an automatic heating appliance according to a second embodiment of the present invention.
Figure 13:
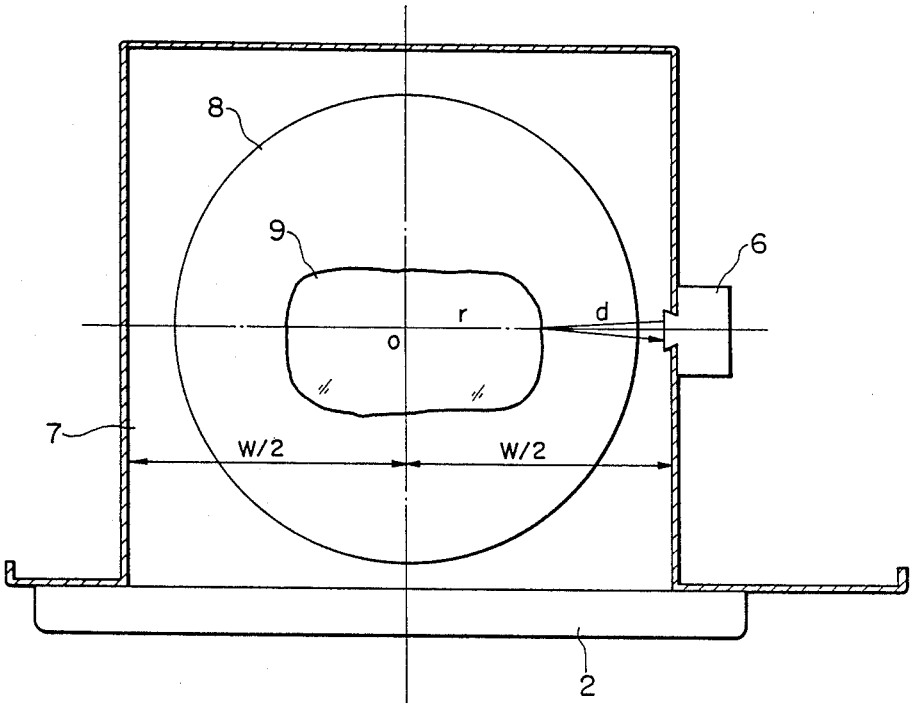

FIGS. 12 and 13 are cross-sectional views showing an automatic heating appliance according to another embodiment of the present invention, FIG. 12 being views from a side and FIG. 13 being viewed from the top. The difference of this embodiment from the first embodiment is that the ultrasonic sensor 6 is provided on a side wall of the heating chamber 7 so that the distance d from the side wall to the object 9 is detected. In FIGS. 12 and 13, the reference 0 represents the origin, i.e. the center of rotation of the turntable 8. When the width of the heating chamber 7 is W, the distance between the origin and the ultrasonic sensor 6 becomes W/2. Thus, if the distance d is detected by the ultrasonic sensor 6, the turning radius r can be obtained on the basis of the detected distance d, i.e., in accordance with $r=(W/2)-d$. The turning radius r is varied in accordance with rotation of the turntable 8, and the plan project area of the object 9 can be obtained by the integral operation of the distance r, resulting in obtaining the external form of the object 9. Thus, the shape data can be obtained from the projected plan.

According to the present invention, the automation of the heating is more improved and, as shown in FIG. 2, the number of the keys are reduced to one or two, resulting in simple operation of the heating appliance.

It should be understood that the foregoing relates to only embodiments of the present invention, and that it is intended to cover all changes and modifications of the embodiments of the invnention herein used for the purposes of the disclosure, which do not constitute departures from the spirit and scope of the invention.

What is claimed is:

1. A heating appliance with a heating chamber, comprising:

heating means for heating an object to be heated which is encased in said heating chamber;

turntable means provided in said heating chamber and arranged to be rotatable, said object being placed on said turntable means;

control means for controlling said ultrasonic sensor means so as to repeatedly transmit and receive an ultrasonic wave and calculate distances of said object form said ultransonic sensor means on the basis of the transmission and reception of the ultrasonic wave, said control means determining the heating condition of said object on the basis of the repeatedly calculated distances and controlling said heating means in accordance with the result of the determination.

2. A heating appliance as claimed in claim 1, further comprising gas sensor means for detecting the vapor or gas generated from said object due to the heating, and wherein said control means determines the heating time period on the basis of the detection of the vapor or gas.

3. A heating appliance as claimed in claim 1, wherein said control means stops to energize said heating means while the distances from said ultrasonic sensor means to said object are measured by said ultrasonic sensor means.

4. A heating appliance as claimed in claim 1, wherein said control means detects the presence or absence of an attachment, which is used to place said object thereon in a predetermined cooking category and alters a manner to control said heating means with the presence or absence of the attachment.

5. A heating appliance with a heating chamber, comprising:

heating means for heating an object to be heated which is encased in said heating chamber;

turntable means provided in said heating chamber and arranged to be rotatable, said object being placed on said turntable means;

ultrasonic sensor means for transmitting an ultrasonic wave toward said object and receiving an echo wave returning therefrom;

weight sensor means for sensing the weight of said object placed on said turntable means; and control means for controlling said ultransonic sensor means so as to repeatedly transmit and receive an ultransonic wave and calculate distances of said object from said ultransonic sensor means on the basis of the transmission and reception of the ultransonic wave, said control means determining the volume of said object on the basis of the successively calculated distances and calculating the density of said object on the basis of the determined volume and the weight sensed by said weight sensor, said control means controlling said heating means in accordance with the calculated density of said object.

6. A heating as claimed in claim 5 further comprising gas sensor means for detecting the vapor or gas generated from said object due to the heating, and wherein said control means determines the heating time period on the basis of the calculated density of said object and the detection of the vapor or gas.

7. A heating appliance as claimed in claim 5, wherein said control means stops to energize said heating means while the distances from said ultransonic sensor means to said object are measured by said ultransonic sensor means.

8. A heating appliance as claimed in claim 5, wherein said control means detects the presence or absence of an attachment, which is used to place said object thereon in a predetermined cooking category, and alters a manner to control said heating means with the presence or absence of the attachment.

9. A heating appliance as claimed in claim 8, wherein said predetermined control manner is determined so that the heating time of said object is determined in accordance with the weight thereof.

10. A heating appliance with a heater chamber, comprising:

heating means for heating an object to be heated which is encased in said heating chamber;

turntable means provided in said heating chamber and arranged to be rotatable, said object being placed on said turntable means;

distance-measuring means for repeatedly measuring the distance from said object; and control means for determining the heating condition of sad object on the basis of the distances repeatedly measured by said distance-measuring means and for controlling said heating means in accordance with the result of the determination.

11. A heating appliance with a heating chamber, comprising:

heating means for heating an object to be heated which is encased in said heating chamber;

turntable means provided in said heating chamber and arranged to be rotatable, said object being placed o said turntable means;

distance-measuring means for repeatedly measuring the distance from said object;

weight sensor means for sensing the weight of said object placed on said turntable means; and control means for determining the volume of said object on the basis of the distances repeatedly measured by said distance-measuring means and for calculating the density of said object on the basis of the determined volume and the weight sensed by said weight sensor means, said control means controlling said heating means in accordance with the calculated density of said object.

* * * * *